US006132276A

United States Patent [19]

Leemon

[11] Patent Number: 6,132,276

[45] Date of Patent: Oct. 17, 2000

[54] CONNECTOR FOR BUOYANT FLOATATION APPARATUSES

[76] Inventor: Arnold Leemon, 2660 Mandale Ter., West Bloomfield, Mich. 48324

[21] Appl. No.: 09/197,215

[22] Filed: Nov. 20, 1998

[51] Int. Cl.[7] ..... B63C 9/08

[52] U.S. Cl. ..... 441/129

[58] Field of Search ..... 206/150; 114/266, 114/267, 352; 441/129–132, 125, 80, 88, 133, 136, 122, 123

[56] References Cited

U.S. PATENT DOCUMENTS

| | | | |
|---|---|---|---|
| 1,625,579 | 4/1927 | Walters | 441/132 |
| 2,936,070 | 5/1960 | Poupitch | 206/150 |
| 4,574,949 | 3/1986 | Rhoads | 206/150 |
| 5,197,404 | 3/1993 | Haley et al. | 114/267 |
| 5,433,637 | 7/1995 | Graves . | |
| 5,441,147 | 8/1995 | Tanner | 206/150 |
| 5,772,484 | 6/1998 | Sikorski . | |

*Primary Examiner*—Ed Swinehart
*Attorney, Agent, or Firm*—Harness, Dickey & Pierce, P.L.C.

[57] ABSTRACT

A lightweight connector for use in association with buoyant members is provided. The connector is in the form of a substantially flexible body having a plurality of spaced apart apertures for receiving one or more buoyant members in a friction fit relationship. By adjusting the location of the connector relative to the buoyant members, the buoyancy of the resulting floatation apparatus can be modified.

23 Claims, 3 Drawing Sheets

CONNECTOR FOR BUOYANT FLOATATION APPARATUSES

BACKGROUND OF THE INVENTION

Field of the Invention

The present invention relates to a connector for coupling one or more buoyant members and, more particularly, to a flexible connector for adjoining a plurality of buoyant members to create various floating apparatuses.

Floatation devices such as inflatable rafts for recreational use in water have been in existence for many years. With the increased popularity of water related recreational activities has come the creation of many specialty floatation devices. For example, U.S. Pat. No. 5,433,637 which issued Jul. 18, 1995 relates to a throwable airfoil floatation device including a supporting structure covered with a cushion making it useful to sit upon. The floatation device is a fixed structure incapable of modification according to a fair interpretation of the specification.

Additionally, U.S. Pat. No. 5,722,484 which issued Jun. 30, 1998 relates to a floatation toy device including a cylindrical elongated member, a variable buoyancy means in the form of a truncated sleeve which is adjustable along the length of the elongated member and a buoyant connection means in the form of a slightly longer sleeve into which the first and second ends of the cylindrical elongated member are friction fit to form a hoop shaped structure.

While the '484 patent attempts to solve a problem in the art relating to the fixed or stationary nature of the known floatation devices, it too suffers from perceived drawbacks which are addressed by the present invention.

For example, the above described floatation device has limited geometrical configurations due to the way the first and second ends of the cylindrical elongated member attach within the buoyant connection means. A further perceived drawback is that prior to inserting the first and second ends of the cylindrical elongated member into the connection means, i.e., attachment collar, an adhesive must be employed to maintain the connection once assembled.

A less complicated device for use in association with buoyant structures is therefore desirable.

SUMMARY OF THE INVENTION

A primary object of the present invention is to provide a connector for use in association with buoyant members of varying design.

In accordance with one aspect of the present invention, there is provided a flexible lightweight connector including a body having first and second apertures for receiving at least one buoyant member in fixed or adjustable relation to form a floatation device. A plurality of connectors may be used to join two or more buoyant members in sequence to form an elaborate floatation apparatus. The adjustable and flexible nature of the connector allows the user to manipulate the buoyant members relative to each other to form a floatation device capable of various configurations such as chairs, hammocks and rafts, by way of non-limiting example. Further, the positioning of the flexible connector along the length of the buoyant member serves to modify the overall buoyancy of the resulting floatation device.

The general features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
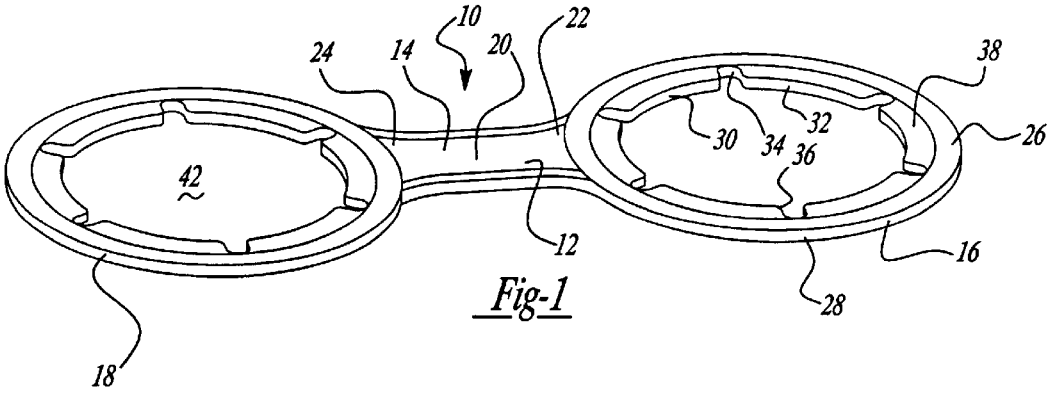
FIG. 1 is a perspective view of the connector in association with a buoyant member in accordance with the teachings of the present invention.
Figure 2:
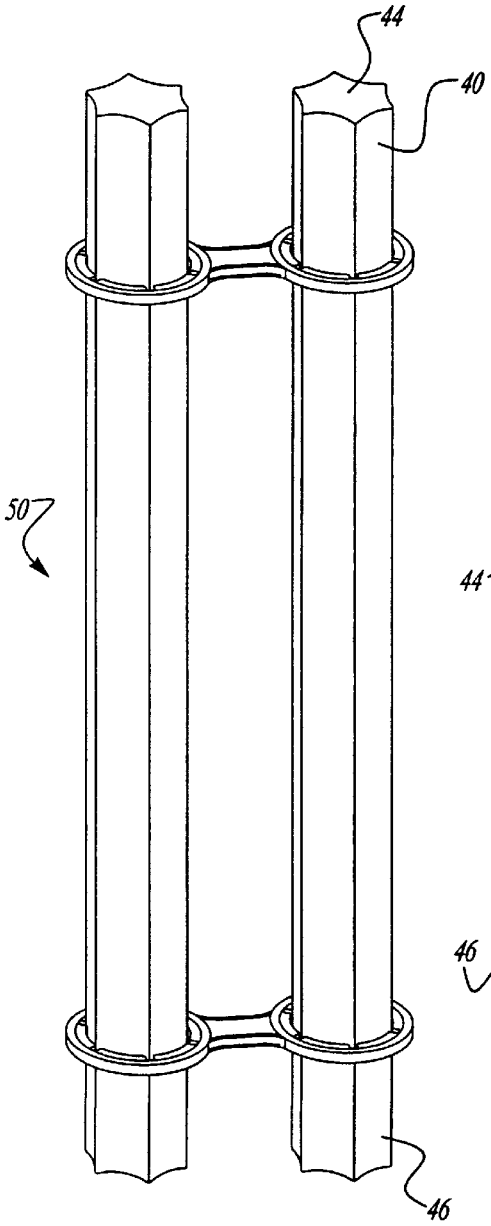
FIG. 2 is a perspective view illustrating connectors as shown in FIG. 1, coupling two distinct buoyant members to form a floatation apparatus.

Referring to FIG. 1, there is shown a connector 10 in accordance with the teachings of the present invention. The connector 10 which is formed from a thermoplastic material via known plastic forming techniques such as injection molding, for example, includes a relatively flat unitary body 12 including a pair of ring members 16 and 18, respectively. While the ring members may be substantially concentric, preferably the ring members 16, 18 are spaced apart along opposite ends of a spacer otherwise referred to herein as a linkage 14. The linkage 14, which preferably is relatively narrow as compared to the ring members 16, 18, includes central portion 20, a first end 22 which attaches to the first ring member 16 and a second end 24 which attaches to the second ring member 18.

Figure 8A:
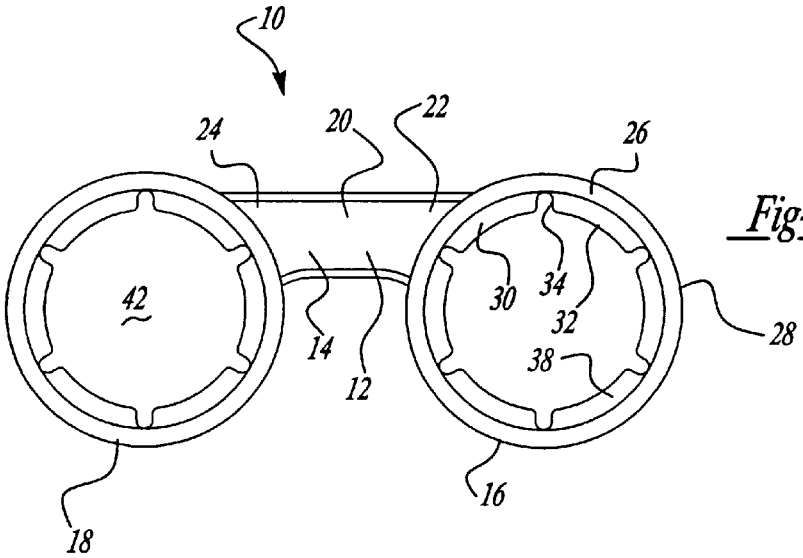
FIGS. 8A and 8B are perspective views of alternate connector embodiments in accordance with the teachings of the present invention.
Figure 8B:
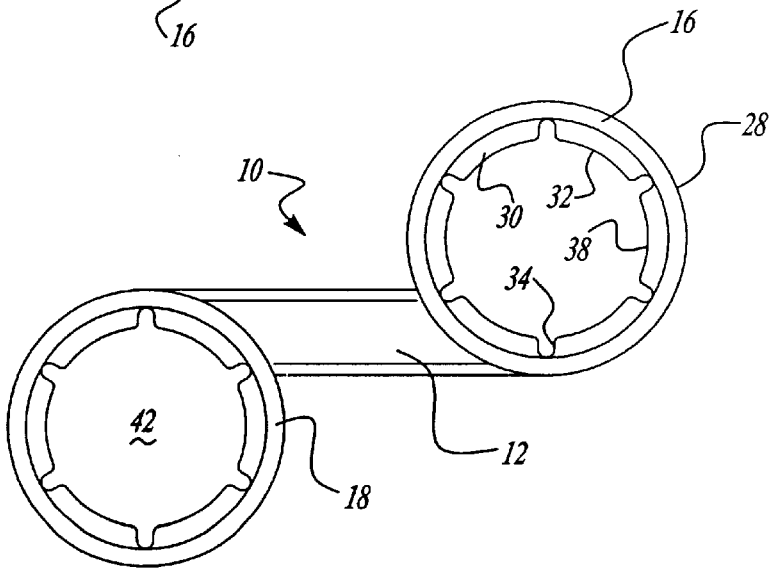

According to the embodiment shown in FIG. 1, when the linkage is disposed along a central axis A—A, the ends 20, 22 of the linkage preferably increase in width as each end approaches the corresponding ring member. This progressive widening from the central portion to each end is intended to enhance the flexibility of the connector. Optionally, the linkage may extend along the top or bottom portions of the ring members, as shown in FIG. 8A or the ring members may extend along opposite sides of the linkage as shown in FIG. 8B.

The ring members 16 and 18 include a built up peripheral rim 26 defining the outer diameter 28 and a substantially continuous inwardly extending fin 30 which extends from the rim 26 to define the inner diameter 32 of the ring member. The peripheral rim 26 is generally at least as thick as the linkage 14 and preferably is thicker to provide structural rigidity to the connector.

The fin 30 generally includes a plurality of spaced apart detents 34 to enhance the flexibility of the fin. Preferably, the detents 34 have rounded edges 36 so as to preclude snagging. Disposed between the plurality of detents 34 are teeth 38 for friction fit attachment to a buoyant member 40.

Figure 7:
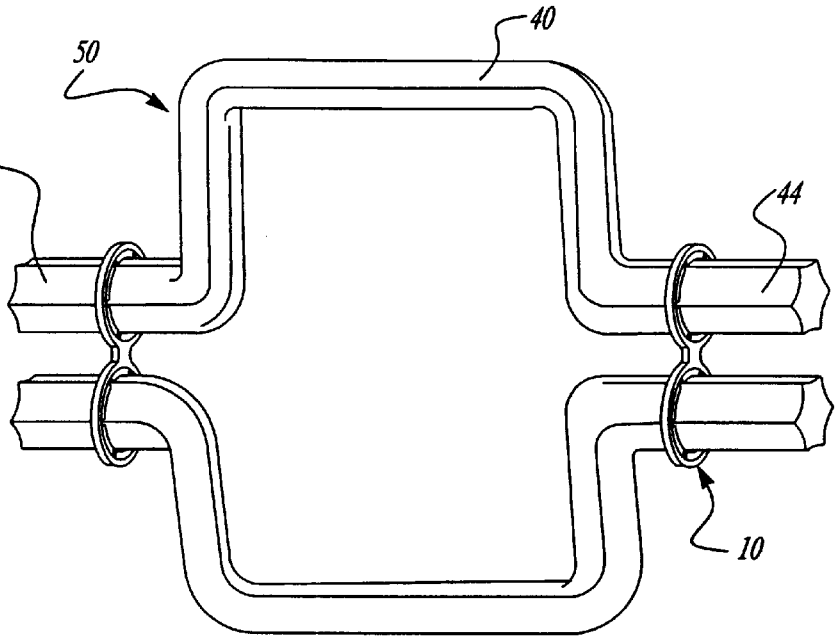
FIG. 7 is a perspective view illustrating an alternate buoyant member embodiment used in association with the connector of the present invention.

The buoyant members 40, which are generally formed from a substantially hydrophobic foam as is known in the floatation device art, may have a variety of shapes as illustrated in FIG. 7, for example. The buoyant members have first and second terminal portions 44 and 46, respectively, capable of insertion through the apertures 42 of the ring members 16, 18 to form a floatation apparatus 50. Preferably, the buoyant members are readily deformable to allow for modifying the configuration of the resulting floatation apparatus.

Figure 3:
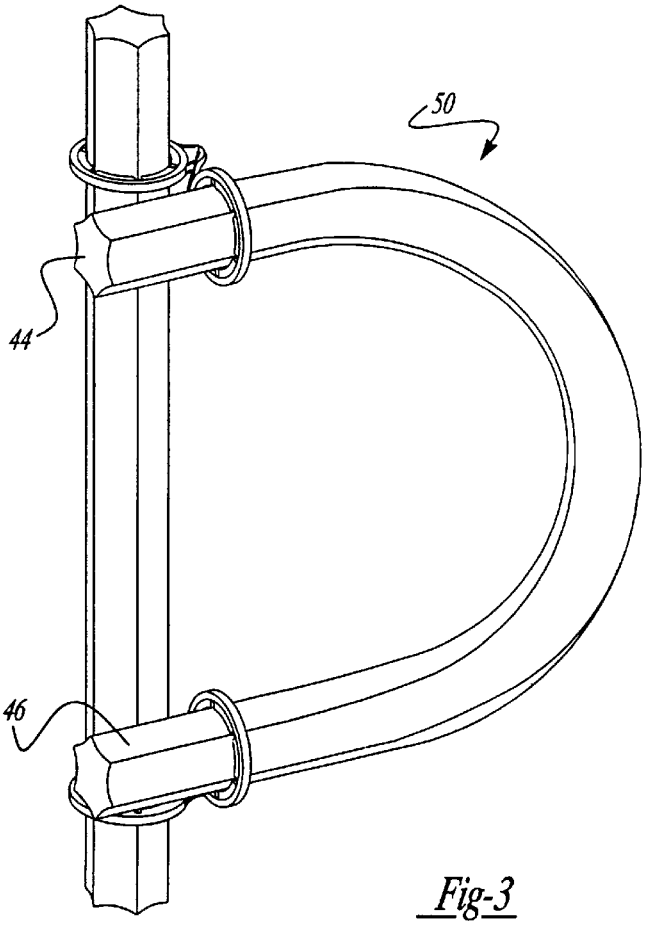
FIG. 3 is a perspective view illustrating the connectors of FIG. 2 manipulated to form a floatation apparatus having a modified configuration.

Once the first and second terminal portions 44, 46 of the buoyant member 40 have been inserted through the apertures 42 such that the buoyant member is securely retained, the connector 10 can be manipulated to modify the configuration of the resulting floatation apparatus 50 as illustrated in FIG. 3. As noted above, the fins 30 included along each ring member are designed to frictionally secure the buoyant members such that no adhesives are required to form a floatation device.

Interestingly, the position at which the connector is attached to the buoyant member can be changed under certain embodiments to alter the overall buoyancy of the resulting floatation apparatus. For example, when two substantially cylindrical buoyancy members are coupled by two or more connectors 10, the connectors may be positioned along various portions of buoyancy members to modify the overall buoyancy of the floatation apparatus.

Further, by using two or more geometrically distinct connectors 10 in combination to couple a plurality of buoyant members, it should be appreciated that floatation apparatuses having a variety of unique designs which can be formed.

Figure 4:
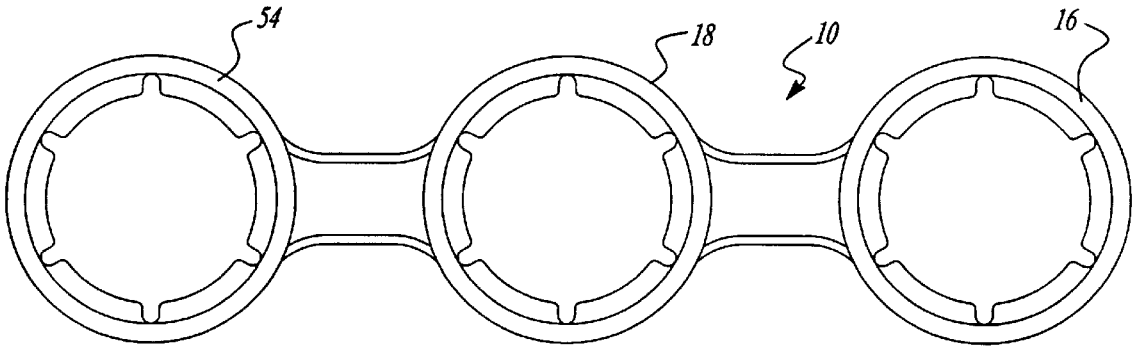
FIG. 4 is a perspective view illustrating an alternative connector embodiment in accordance with the teachings of the present invention.
Figure 5:
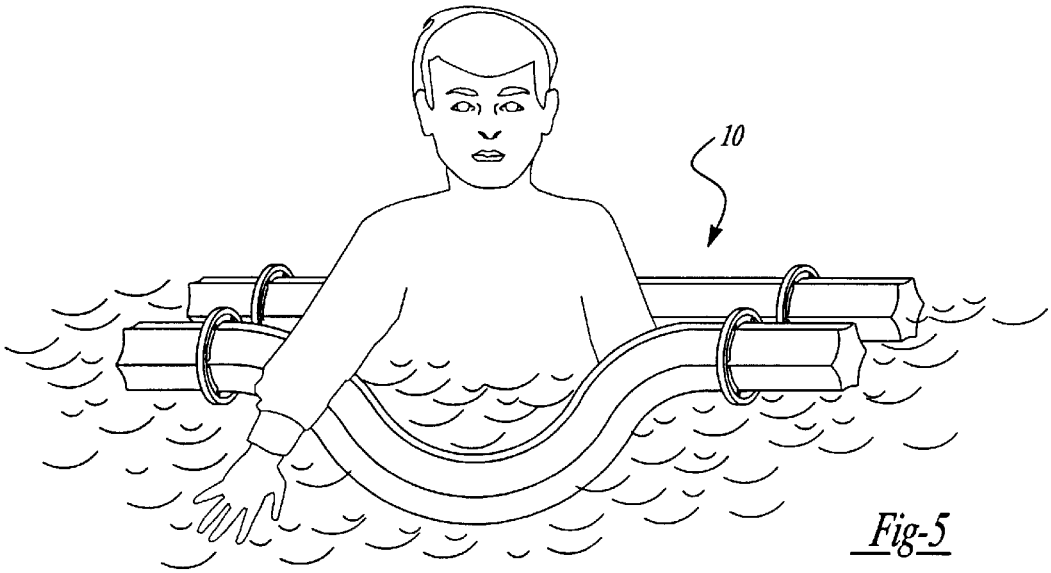
FIG. 5 is a perspective view illustrating a connected floatation apparatus being used.
Figure 6:
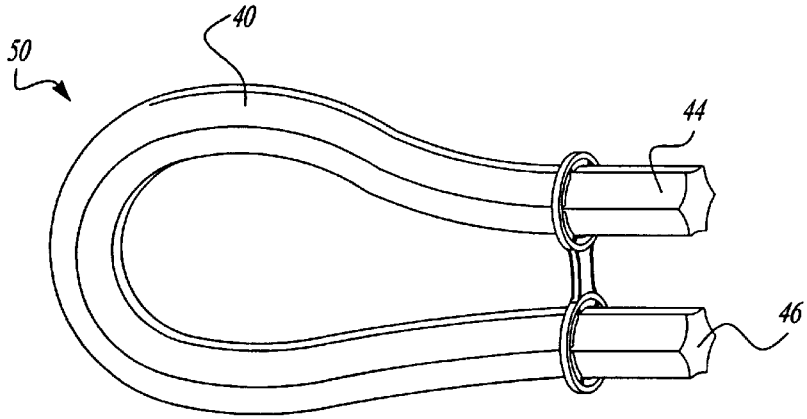
FIG. 6 is a perspective view of a single buoyant member coupled by a connector in accordance with the teachings of the present invention.

In this regard, a pair of connectors 10 as illustrated in FIG. 4 including a first ring member 16, a second ring member 18 and a third ring member 54 could be employed to form a raft (not shown) by way of non-limiting example.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A flexible connector for use in association with a buoyant member including terminal portions, said flexible connector comprising:

a flexible body including a first ring member having an aperture and a second member having an aperture, at least one of said apertures including an inwardly extending fin to define the inner diameter of said ring member to receive said buoyant member, whereby a floatation apparatus may be formed.

2. The flexible connector of claim 1 wherein said connector is formed from a thermoplastic material.

3. The flexible connector of claim 1 further comprising a linkage disposed between said first and second ring members.

4. The flexible connector of claim 1 wherein said flexible unitary body is substantially flat.

5. The flexible connector of claim 1 wherein said fin includes a plurality of spaced apart detents to define teeth.

6. The flexible connector of claim 5 wherein said detents have rounded edges.

7. The flexible connector of claim 1 wherein a plurality of said connectors may be used to couple a plurality of buoyant members.

8. The flexible connector of claim 1 further comprising a third ring member having an aperture for receiving a buoyant member in a friction fit relationship.

9. A flexible connector for coupling a plurality of buoyant members including first and second terminal portions, said connectors comprising:

a flexible unitary body including a first ring member having an aperture adapted to receive a terminal portion of a first buoyant member, a second ring member having an aperture adapted to receive a terminal portion of a second buoyant member and a linkage extending between said ring member, wherein at least one of said apertures includes an inwardly extending fin to define the inner diameter of said ring member, whereby a floatation apparatus may be formed by inserting the terminal portions of the buoyant members through the apertures of said first and second ring members.

10. The flexible connector of claim 9 wherein said connector is formed from a thermoplastic material.

11. The flexible connector of claim 9 wherein said flexible unitary body is substantially flat.

12. The flexible connector of claim 9 wherein said inwardly extending fin includes a plurality of spaced apart detents.

13. The flexible connector of claim 10 wherein said first and second ring members include a substantially continuous inwardly extending fin to define the inner diameter of said ring members.

14. The flexible connector of claim 9 further comprising a third ring member having an aperture for receiving a buoyant member in a friction fit relationship.

15. A buoyant floatation apparatus comprising:

at least one buoyant member including first and second terminal portions; and a flexible connector including a unitary body having a first ring member including an aperture and a second ring member including an aperture, wherein at least one of said apertures includes a substantially continuous inwardly extending fin to define the inner diameter of said aperture, whereby said terminal portions of said buoyant member are inserted through and securely retained by said apertures to form a floatation apparatus.

16. The buoyant floatation apparatus of claim 15 wherein said buoyant member is readily deformable.

17. The buoyant floatation apparatus of claim 15 wherein said connector is formed from a thermoplastic material.

18. The buoyant floatation apparatus of claim 15 further comprising a linkage disposed between said first and second ring members.

19. The buoyant floatation apparatus of claim 15 wherein said flexible unitary body is substantially flat.

20. The buoyant floatation apparatus of claim 15 wherein said substantially continuous fin includes a plurality of spaced apart detents to define teeth.

21. The buoyant floatation apparatus of claim 20 wherein said detents have rounded edges.

22. The buoyant floatation apparatus of claim 15 wherein a plurality of said connectors couple a plurality of buoyant members including first and second terminal portions.

23. The buoyant floatation apparatus of claim 15 further comprising a third ring member having an aperture for receiving a buoyant member in a friction fit relationship.

* * * * *